United States Patent [19]

Floyd

[11] Patent Number: 4,995,295

[45] Date of Patent: Feb. 26, 1991

[54] LID WRENCH

[76] Inventor: Fred D. Floyd, 1403 Fairview Ave., Monroe, La. 71201

[21] Appl. No.: 506,158

[22] Filed: Apr. 9, 1990

Related U.S. Application Data

[63] Continuation-in-part of Ser. No. 375,678, Jul. 5, 1989, Pat. No. 4,949,576.

[51] Int. Cl.[5] ..... B07B 7/00

[52] U.S. Cl. ..... 81/3.44; 81/2.42; 7/156

[58] Field of Search ..... 81/3.09, 3.25, 3.42, 81/3.44; 7/156

[56] References Cited

U.S. PATENT DOCUMENTS

| | | | |
|---|---|---|---|
| 936,035 | 10/1909 | Pratt . | |
| 998,014 | 7/1911 | Kingsley | 81/3.42 X |
| 1,398,125 | 11/1921 | Carleton et al. . | |
| 1,672,311 | 6/1928 | Ermatinger . | |
| 2,002,906 | 5/1935 | Mullan . | |
| 2,458,806 | 1/1949 | Tippett . | |
| 2,507,789 | 5/1950 | Jessup . | |
| 2,541,216 | 2/1951 | Derby . | |
| 2,578,379 | 12/1951 | Taylor | 81/3.44 |
| 2,913,938 | 11/1959 | Yorba | 81/3.44 |
| 2,931,258 | 4/1960 | Ronning | 81/3.44 |

FOREIGN PATENT DOCUMENTS

| | | | |
|---|---|---|---|
| 81298 | 6/1919 | Switzerland | 81/3.42 |
| 587004 | 4/1947 | United Kingdom | 81/3.44 |
| 589740 | 6/1947 | United Kingdom | 81/3.42 |
| 648030 | 12/1950 | United Kingdom | 81/3.44 |

*Primary Examiner*—James G. Smith

*Attorney, Agent, or Firm*—John M. Harrison

[57] ABSTRACT

A lid wrench for removing lids from jars and other containers, which lid wrench is characterized in a first embodiment by an elongated channel member having parallel, downwardly-extending flanges and spaced openings for selectively receiving the engaging finger of a single pivoting lug provided with inwardly-facing lug teeth. In a second embodiment, an elongated plate is provided with spaced openings for selectively receiving the engaging finger of the sliding pivoting lug. A fixed handle is attached to one end of the channel and plate, respectively, opposite the pivoting lug and an opening may be provided at the opposite end of the channel member and plate, respectively, for hanging the lid wrench on a nail or other support. A jaw plate is rigidly attached to the channel member and plate, respectively, at the fixed handle end thereof and a spring-biased, curved jaw, provided with multiple, spaced jaw teeth which face the lug teeth on the pivoting lug, is pivotally secured to the jaw plate and receives a jaw handle. Gripping and squeezing of the fixed handle and the jaw handle pivots the curved jaw against the bias of the spring in a camming action against a jar lid or cap disposed between the jaw teeth and the lug teeth located on the pivoting lug, to loosen the lid or cap responsive to counterclockwise twisting of the lid wrench.

28 Claims, 2 Drawing Sheets

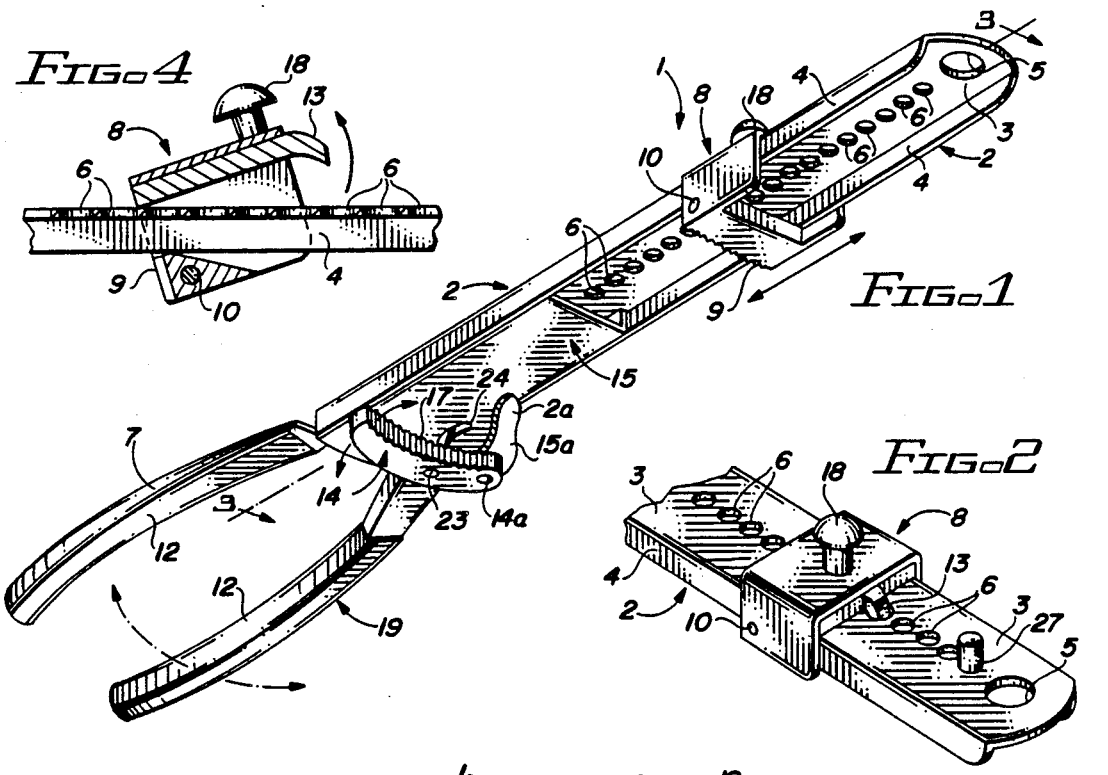
FIG. 4
FIG. 1
FIG. 2
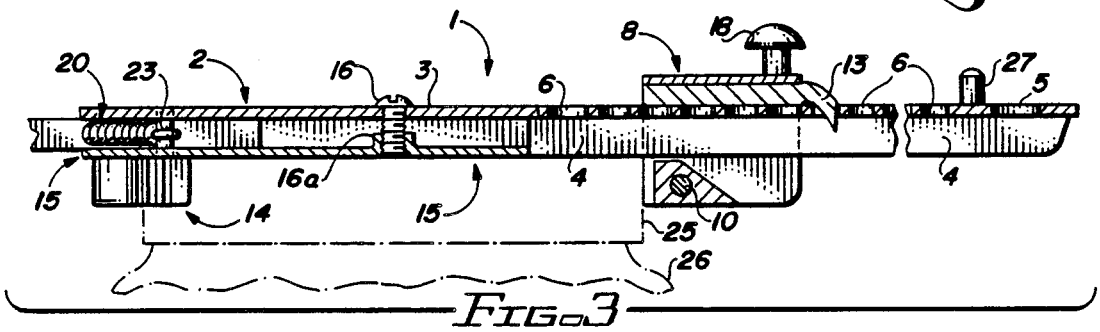
FIG. 3
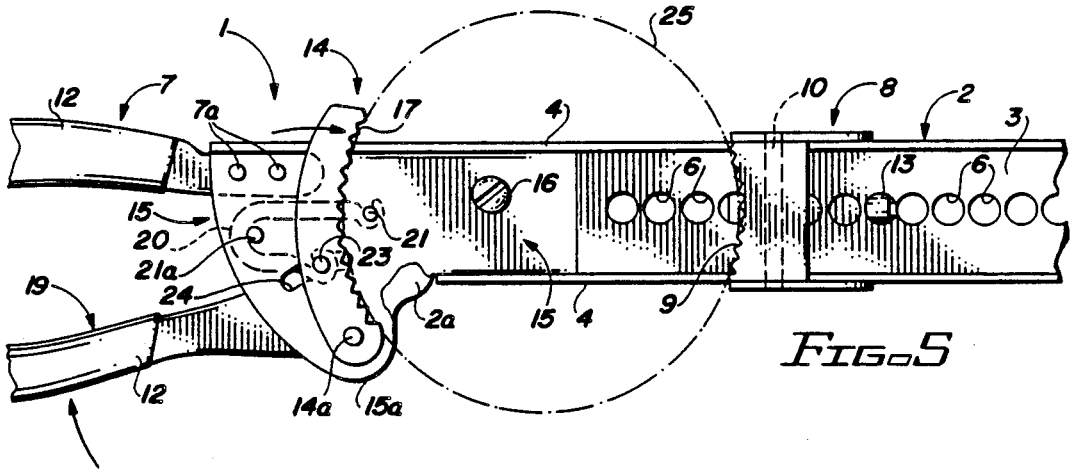
FIG. 5

LID WRENCH

BACKGROUND OF THE INVENTION

Cross-Reference to Related Applications

This application is a continuation-in-part of my copending U.S. patent application Ser. No. 07/375,678, filed July 5, 1989 now U.S. Pat. No. 4,949,576.

FIELD OF THE INVENTION

This invention relates to tools for removing lids and caps from jars and other containers. More particularly, the invention relates to a lid wrench for accomplishing this function, which lid wrench is characterized by an elongated, perforated channel member, in a first embodiment and a plate member, in a second embodiment, each fitted with a slidably adjustable, pivoting lug having lug teeth on one face thereof. A fixed handle and a flat jaw plate are provided on one end of the channel member and plate member, respectively, opposite the pivoting lug. A curved jaw, fitted with multiple teeth which face the lug teeth located on the pivoting lug and spring-loaded in the open configuration, is pivotally attached to the jaw plate and is fitted with a jaw handle. Accordingly, lightly squeezing the jaw handle toward the fixed handle against the bias of the spring causes the jaw to pivot in a camming action toward the pivoting lug to grip a jar lid or container cap positioned between the jaw teeth and the lug teeth of the pivoting lug. The pivoting lug is slidably and adjustably mounted on the channel and plate members, respectively, such that jar lids and other container lids and caps of various diameter can be fitted between the lug teeth of the pivoting lug and the jaw teeth in easily adjustable fashion and the camming action of the jaw against the lid secures the lid between the jaw teeth and the lug teeth to facilitate loosening the jar lid with a twisting action of the hand. A coil spring having one end secured to the jaw plate and the opposite end attached to the curved jaw serves to normally bias the jaw handle away from the fixed handle in open configuration.

A frustrating problem which is well known to everyone is that of loosening threaded jar lids and other container caps and lids to remove the contents of the container. The problem is not limited to lids and caps which are compression-sealed and threaded on jars and other containers, but also to plastic caps or covers which are sometimes sealed by means of plastic retainers on beverage bottles and other containers. In the case of many beverage bottles, the plastic retainers must first be severed by a knife before the lid can be removed, a practice which is dangerous and time-consuming. Since the lids applied to such containers as pickle jars, for example, are normally smooth and difficult to grip, the lids are frequently difficult to remove with the bare hands, even by one having a strong grip.

Various types of jar-opening aids and mechanisms have been devised and are known in the art for removing lids and caps from jars and other containers. A commonly used device is a flexible rubber disk which is placed over the jar lid and gripped by the user to maintain a tight friction fit between the hand and the jar lid, in order to exert sufficient friction to open the lid. Another device is detailed in U.S. Pat. No. 936,035, dated Oct. 5, 1909, to W. A. Pratt, entitled "Wrench". The Pratt wrench is characterized by a pair of generally Z-shaped rods or bars which are pivoted at one end and contain a V-shaped member for engaging a jar or container lid, gripping the lid and exerting sufficient pressure to remove the lid from the container. U.S. Pat. No. 1,398,125, dated Nov. 22, 1921, to W. A. Carleton, et al, details another wrench which includes an elongated handle provided with a pair of jaws thereon, the jaws having jaw teeth for receiving, engaging and removing a jar lid. A "Can Top Remover" is detailed in U.S. Pat. No. 2,002,906, dated May 28, 1935, to J. H. Mullan. The can top remover is characterized by an elongated, slotted plate provided with a set of fixed teeth at the end thereof and a handle pivotally and slidably attached to the fixed member at the slot. The handle is provided with additional jaw teeth for slidably engaging a container lid located between the two sets of teeth, rotating the handle and removing the lid. U.S. Pat. No. 1,672,311, dated June 5, 1928, to P. Ermatinger, details a "Jar Holder" which is characterized by a split-ring provided with a pair of handles and fitted with oppositely-disposed, slotted adjusting members, wherein the fixed ring can be fitted over a jar cap or lid, the adjusting members adjusted on the ring to engage the cap or lid and the handles of the ring squeezed to tighten the ring, secure the adjusting members against the cap or lid and remove the lid. A "Receptacle Cover Pry-Off Tool" is detailed in U.S. Pat. No. 2,458,806, dated Jan. 11, 1949, to J. C. Tippett. The pry-off tool is characterized by a handle provided with a threaded rod and having a pair of oppositely-disposed, concave jaws fitted with jaw teeth, one of which jaws is fixed to the end of the threaded rod and the other threadably adjustable thereon. The lid of a jar or other container is fitted between the two sets of jaws and the threaded jaw is then tightened against the lid to facilitate removal of the lid from the jar or container. U.S. Pat. No. 2,507,789, dated May 16, 1950, to S. E. Jessup, details a "Reciprocating Jaw Jar Wrench" which includes an elongated plate provided with a pair of oppositely-disposed jaws having jaw teeth, both of which jaws are movable on the plate. One of the jaws is fitted with a spring-loaded handle for exerting pressure against a container lid located between the jaws and removing the container lid from the container. U.S. Pat. No. 2,541,216, dated Feb. 13, 1951, to G. T. Derby, details a "Pivoted Jaw Screw Cap Remover". The device includes a flat, elongated, slotted plate provided with a first jaw fixed to the end thereof and a slidably adjustable jaw located intermediate the ends of the plate. The adjustable jaw is adjusted by means of a rod attached thereto to secure the jaws against a lid or cap located therebetween and remove the lid or cap from a container. U.S. Pat. No. 2,578,379, dated Dec. 11, 1951, to S. M. Taylor, details a "Pivoted Jaw Closure Remover with Eccentric Pivot". The device includes a mount plate provided with an adjustable jaw at one end, which jaw is adjustable on the mount plate by means of a peg-and-hole arrangement. An eccentric cam is provided at the opposite end of the mount plate for engaging one side of a jar lid, the opposite side of the lid engaging the adjustable plate for removing the lid from the jar. U.S. Pat. No. 2,931,258, dated Apr. 5, 1960, to J. A. Ronning, Jr., details an "Opener for Screw Caps". The opener is characterized by an elongated base member provided with spaced slots and a downwardly-extending grip portion at one end, with a handle adjustably attached to the elongated member by means of a pin and having a lug which engages a jar or container lid located between the grip portion and the handle lug for removing the lid from the container.

It is an object of this invention to provide a new and improved lid wrench which is characterized by a channel member having multiple, longitudinally spaced openings and provided with a fixed handle at one end, a single pivoting lug slidably fitted to the channel member and adapted to selectively, adjustably and pivotally engage the holes in the channel member and a pivoting jaw and companion jaw handle pivotally attached to the channel member adjacent to the fixed handle, for locating the lid of a container between the pivoting jaw and the pivoting lug in adjustable relationship and loosening the lid on the container.

Another object of the invention is to provide a lid wrench which is characterized by an elongated channel or plate member fitted with longitudinally spaced openings and a pivoting lug having lug teeth on one face thereof and an engaging finger, for sliding on the channel or plate and selectively and adjustably engaging the holes in the channel or plate, a fixed handle attached to one end of the channel or plate and a pivoting jaw fitted with jaw teeth and a jaw handle, pivotally secured to the end of the channel or plate adjacent to the fixed handle, wherein squeezing of the two handles rotates the pivoting jaw toward the pivoting lug and secures a container lid between the pivoting lug and the pivoting jaw, for twisting of the container lid from the container.

Another object of this invention is to provide a new and improved lid wrench which is characterized by an elongated channel having a flat channel plate fitted with multiple, longitudinally spaced openings and downwardly-extending side flanges; a single toothed lug pivotally disposed in the channel in slidably adjustable relationship and having a downwardly-extending engaging finger for selectively engaging the spaced openings and one side of a container lid; a fixed handle attached to the channel; and a toothed pivoting jaw and companion jaw handle pivotally attached to the channel in spaced, spring-biased relationship with respect to the fixed handle, for engaging the opposite side of the container lid and loosening the container lid on the container with a twist of the hand.

SUMMARY OF THE INVENTION

These and other objects of the invention are provided in a new and improved lid wrench for removing lids and caps from jars and other containers, which lid wrench is characterized by an elongated channel or flat plate member fitted with multiple, longitudinally spaced openings and a slidable, pivoting lug mounted on the channel or plate member, the lug having an engaging finger capable of selectively engaging the openings in the channel or plate member and plate teeth opposite the engaging finger; a fixed handle and a jaw plate rigidly provided on the end of the channel or plate member opposite the pivoting lug, a pivoting, spring-biased, toothed jaw pivotally attached to the jaw plate; and a jaw handle rigidly attached to the jaw and spaced from the fixed handle. A container lid may be disposed between the jaw teeth and the lug teeth of the pivoting lug and gripped by squeezing the handles and urging the jaw handle toward the fixed handle against the spring bias, to grip the lid and remove the lid from the container with a twist of the hand.

BRIEF DESCRIPTION OF THE DRAWING

The invention will be better understood by reference to the accompanying drawing, wherein:

FIG. 1 is a bottom perspective view of a first preferred embodiment of the lid wrench of this invention in lid-engaging configuration;

FIG. 2 is a top perspective view of the engaging end of the lid wrench illustrated in FIG. 1;

FIG. 3 is a sectional view taken along line 3—3 of the lid wrench illustrated in FIG. 1, with a phantom container lid engaged by the lid wrench;

FIG. 4 is a side sectional view of the channel member of the lid wrench illustrated in FIG. 2, with the pivoting lug of the lid wrench oriented in sliding and adjusting configuration;

FIG. 5 is a bottom view, partially in section, of the lid wrench illustrated in FIGS. 1–4, with the phantom lid engaged by the lid wrench;

DESCRIPTION OF THE PREFERRED EMBODIMENTS

Figures 6, 7, 8, 9, 10:
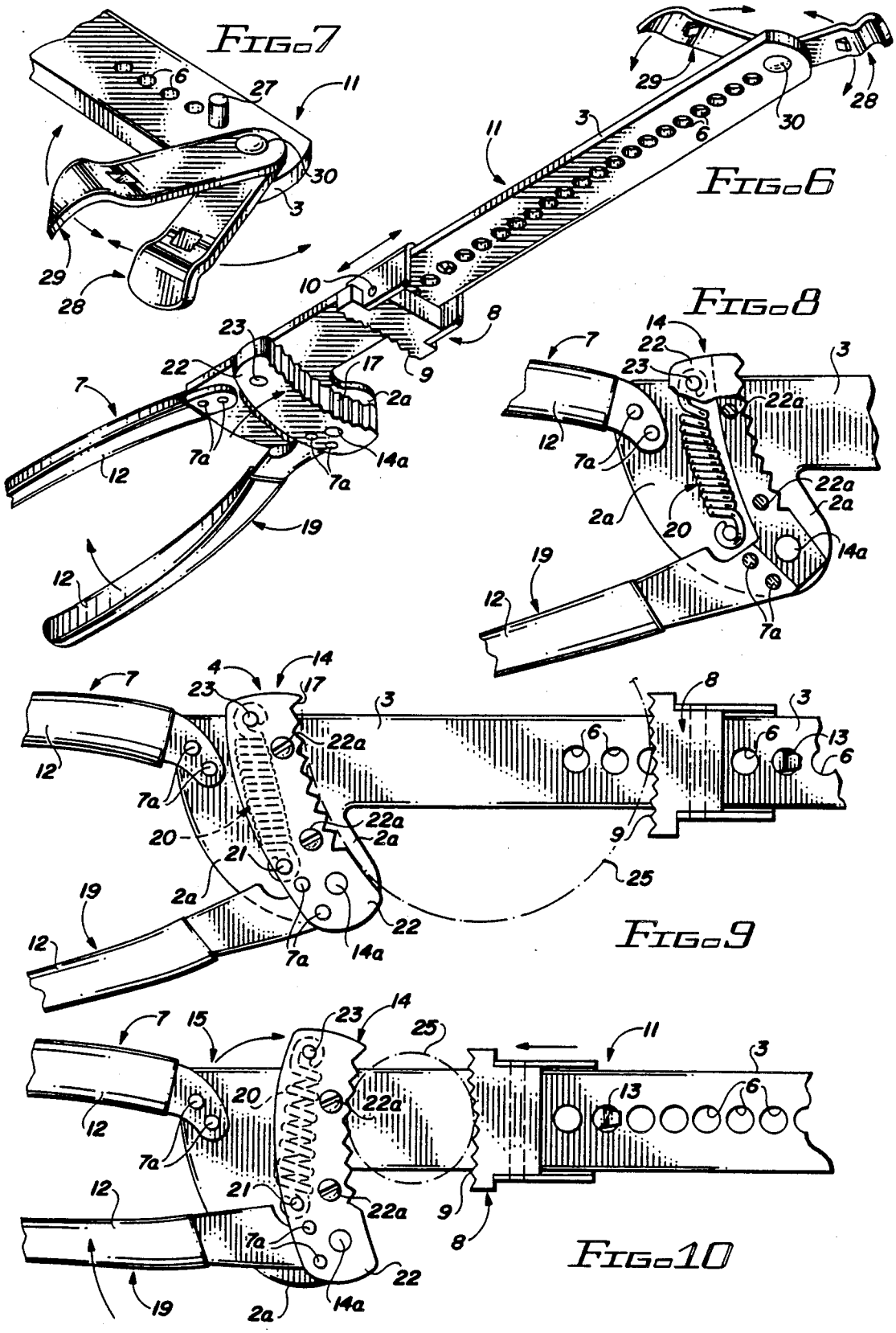
FIG. 6 is a bottom perspective view of a second preferred embodiment of the lid wrench of this invention, more particularly illustrating alternative pivotally mounted lid removing and perforating tools.
FIG. 7 is a top perspective view, partially in section, of the engaging end of the lid wrench illustrated in FIG. 6.
FIG. 8 is a bottom view, partially in section, of the pivoting jaw component of the lid wrench illustrated in FIGS. 6 and 7.
FIG. 9 is a bottom view, partially in section, of the lid wrench illustrated in FIG. 6, with the jaw in open, disengaging configuration.
FIG. 10 is a bottom view, partially in section, of the lid wrench illustrated in FIG. 9, with the jaw deployed in engaging configuration, more particularly illustrating the coil spring component for normally biasing the lid wrench handles apart.

Referring initially to FIGS. 1–5 of the drawings, a first embodiment of the self-adjusting lid wrench of this invention is characterized by a channel lid wrench generally illustrated by reference numeral 1. The channel lid wrench 1 is characterized by an elongated channel 2, defined by a flat channel plate 3, having plate flanges 4 extending from opposite edges thereof in parallel relationship. An optional plate opening 5 is provided in one end of the channel plate 3 for suspending the lid wrench 1 from a nail, peg or other protrusion (not illustrated), when the lid wrench 1 is not in use. A jaw plate 15 is removably secured to the opposite end of the channel plate 3 from the plate opening 5, by means of a plate mount screw 16, which engages an internally threaded screw receptacle **16*a*, projecting upwardly from the channel plate 3, as illustrated in FIG. 3. The jaw plate 15 is shaped to define an extending plate finger 15*a*, which lies parallel to and is spaced from a like-shaped channel finger 2*a*, which projects from the channel 2, as illustrated in FIG. 1. A fixed handle 7 is also secured to the opposite end of the channel plate 3 of the channel 2 and to the jaw plate 15 by means of the handle brads 7*a*, as further illustrated in FIG. 5. One end of a curved jaw 14 is pivotally secured to the plate finger 15*a* and the channel finger 2*a* by means of a jaw pin 14*a*, also as illustrated in FIG. 5, which jaw pin 14*a* extends through a jaw pin opening (not illustrated) provided in the jaw 14 and through corresponding openings (not illustrated) provided in the plate finger 15*a* of the jaw plate 15 and the channel finger 2*a*, which extends parallel to the plate finger 15*a*. A jaw handle 19 is pivotally disposed between the plate finger 15*a*** and the corresponding channel finger 2a, projecting from the channel 2 and is fixedly attached to the pivoted end of the jaw 14 by means of the jaw pin 14a and the jaw post 23. The curved jaw 14 is provided with multiple jaw teeth 17, which extend along the concave edge thereof from the jaw pin 14a to the pivoting end of the jaw 14. A curved post slot 24 is provided in the jaw plate 15 and a jaw post 23 is mounted in the jaw 14 and projects in registration with the post slot 24, as illustrated in FIG. 1. A spring post 21 and a keeper post 21a are mounted in the jaw plate 15 and the channel plate 3 in spaced relationship and a coil spring 20 is seated in a U-shaped configuration between the jaw plate 15 and the channel plate 3, and extends around the keeper post 21a, with one end of the coil spring 20 attached to the spring post 21 and the opposite end to the jaw post 23, as illustrated in FIG. 5. This positioning of the coil spring 20 biases the jaw post 23 rearwardly in the post slot 24 and the jaw handle 19 outwardly. A pivoting lug 8 is slidably and adjustably mounted on the channel plate 3 of the channel 2, as hereinafter further described.

Referring now to FIGS. 6–10, like the channel lid wrench 1, the plate lid wrench 11 is characterized by a flat channel plate 3 and a jaw 14 pivotally secured to a channel finger 2a, projecting from the channel plate 3, by means of a jaw pin 14a. A spring guard plate 22 is mounted on the jaw 14 by means of a pair of plate screws 22a and receives one end of the jaw pin 14a, as particularly illustrated in FIGS. 8–10. A coil spring 20 is disposed beneath the spring guard plate 22 adjacent the channel plate 3 and channel finger 2a, with one end of the coil spring 20 attached to a spring post 21, fixed to the channel finger 2a and the other end secured to a jaw post 23, extending in fixed relationship from the jaw 14, as further illustrated in FIGS. 8–10. A first pair of handle brads 7a serve to mount the fixed handle 7 on the channel plate 3, while a second pair of the handle brads 7a secure the jaw handle 19 on the spring guard plate 22, as illustrated in FIG. 9. Optional plastic handle covers 12 may be provided on the fixed plate handle 7 and the jaw plate handle 19 of both the channel lid wrench 1, as illustrated in FIGS. 1–5, and the plate lid wrench 11, as further illustrated in FIGS. 8–10. It will be appreciated from a consideration of both the channel lid wrench 1 illustrated in FIGS. 1–5 and the plate lid wrench 11 illustrated in FIGS. 6–10, that when the jaw handle 19 is depressed toward the fixed handle 7, the jaw 14 pivots on the jaw pin 14a toward the pivoting lug 8, which is slidably mounted on the channel plate 3, as hereinafter further described.

Referring now to FIGS. 1–6, 9 and 10 of the drawings, in both the channel lid wrench 1 and the plate lid wrench 11, the pivoting lug 8 is pivotally and slidably disposed on the channel plate 3 by means of a lug pin 10, which extends beneath the plate flanges 4 in the channel lid wrench 1 and the channel plate 3 in the plate lid wrench 11, respectively. A downwardly-extending engaging finger 13 is adapted for seating in a selected one of the several engaging finger openings 6, provided in the channel plate 3, as illustrated in FIGS. 1–3, 5, 6, 9 and 10. The pivoting lug 8 is fitted with multiple plate teeth 9, provided on an engaging surface which faces the jaw teeth 17 in the jaw 14. The pivoting lug 8 is designed to pivot on the lug pin 10 to selectively extend the engaging finger 13 from the engaging finger openings 6 in slidably adjustable configuration, as illustrated in FIG. 4, and into a selected one of the engaging finger openings 6 in locking configuration, as illustrated in FIGS. 2, 3, 5 and 10. In pre-gripping configuration, when the channel lid wrench 1 or plate lid wrench 11 is oriented over the lid 25 of a jar 26 (illustrated in phantom in FIGS. 3, 5 and 10) the pivoting lug 8 is initially pivoted on the lug pin 10 to release the engaging finger 13 from one of the engaging finger openings 6, as illustrated in FIG. 4. The pivoting lug 8 is then slidably adjusted along the channel plate 3 to engage the lid 25, and the pivoting lug 8 is pivoted in the opposite direction to again seat the engaging finger 13 in a selected engaging finger opening 6, to anchor the pivoting lug 8 in place. When the jaw handle 19 is forced toward the fixed handle 7, the lug teeth 9 of the pivoting lug 8 securely grip one side of the lid 25, as illustrated in FIGS. 3, 5 and 10, while an opposite side of the lid 25 is engaged by the jar teeth 17 as the jaw handle 19 approaches the fixed handle 7, thereby rotating the jaw 14 toward the pivoting lug 8. The lid 25 is therefore securely gripped between the pivoting lug 8 and the jaw 14 and removal of the lid 25 from the jar 26 is easily accomplished with a counterclockwise twisting motion of the hand, which further tightens the jaw teeth 17 and lug teeth 9 on the lid 25.

In detailed operation, and referring again to the drawings, both embodiments of the lid wrench 1 may be initially oriented with the pivoting lug 8 extended along the channel plate 3 to a desired location by pivotally disengaging the engaging finger 13 from the engaging finger openings 6. The channel lid wrench 1 or plate lid wrench 11 is then positioned over the lid 25 of a jar 26 and the channel lid wrench 1 or plate lid wrench 11 is lowered until the plate flanges 4 or the channel plate 3, respectively, engage the lid 25. The pivoting lug 8 is then again slidably adjusted along the channel plate 3 until the lug teeth 9 engage the outer edge of the lid 25, as illustrated in FIGS. 3, 5 and 10. This action seats the channel lid wrench 1 or plate lid wrench 11 into pre-engaging configuration on the lid 25. The jaw handle 19 and fixed handle 7 are then lightly squeezed to move the jaw handle 19 toward the fixed handle 7 against the bias of the coil spring 20, pivot the jaw 14 inwardly toward the pivoting lug 8 and secure the lid between the lug teeth 9 of the pivoting lug 8 and the jaw teeth 17 of the jaw 14. The lid 25 is then easily loosened on and removed from the jar 26 by a counterclockwise twisting action of the hand.

Referring again to the drawings, it will be appreciated by those skilled in the art that both the channel lid wrench 1 and the plate lid wrench 11 are capable of engaging and loosening lids 25 of various diameter due to the aligned and spaced arrangement of the engaging finger openings 6 in the channel plate 3, respectively. As illustrated in FIGS. 1–4, a grip 18 is provided on the pivoting lug 8 to facilitate gripping the pivoting lug 8 and pivoting the engaging finger 13 into and from the engaging finger openings 6 in the channel plate 3. Furthermore, a lug stop 27 is upward-standing from the engaging end of the channel plate 3 in the channel lid wrench 1 and downwardly projecting from the channel plate 3 in the plate lid wrench 11, to prevent sliding of the pivoting lugs from the channel plate 3, respectively. It will be appreciated that only a minimal gripping force is necessary for application to the fixed handle 7 and the jaw handle 19 in operating both the channel lid wrench 1 and the plate lid wrench 11, since the counterclockwise twisting action of the channel lid wrench 1 and plate lid wrench 11 serves to tighten the lug teeth 9 and the jaw teeth 17 on the lid 25 and facilitate removal of the lid 25 from the jar 26. It will be appreciated that the engaging finger openings 6 are most preferably slanted forwardly from the top to the bottom to more firmly and positively seat the engaging finger 13. Furthermore, a countersink may also be provided in each of the engaging finger openings 6, to better facilitate rearward adjustment of the pivoting lug 8 toward the jaw 14.

As further illustrated in FIGS. 6 and 7, a conventional lid removing tool 28 and a lid perforating tool 29 are pivotally secured to the extending end of the channel plate 3 by means of a pivot pin 30, for use in conventional fashion.

While the preferred embodiments of the invention have been described above, it will recognized and understood that various modifications may be made therein and the appended claims are intended to cover all such modifications which may fall within the spirit and scope of the invention.

Having described my invention with the particularity set forth above, what is claimed is:

1. A lid wrench for removing a lid from a container, comprising a lug support; a plurality of openings provided in said lug support; lug means pivotally carried by said lug support, said lug means adapted to selectively engage and disengage said openings in slidably adjustable relationship; a fixed handle carried by said lug support in fixed relationship; jaw means pivotally carried by said lug support in spaced relationship with respect to said lug means; and a jaw handle carried by said jaw means in fixed relationship, whereby said lug means and said jaw means engage the lid and the lid is loosened on the container responsive to insertion of said lid wrench over the lid between said lug means and said jaw means, squeezing said jaw handle toward said fixed handle and twisting said lid wrench in the counterclockwise direction.

2. The lid wrench of claim 1 wherein said lug means further comprises a lug mounted in pivotal and slidable relationship on said lug support and lug teeth and finger means provided on said lug, whereby said lug is selectively pivoted on said lug support to orient said finger means in non-engaging, slidable configuration with respect to said openings and into engaging, non-slidable configuration with said finger means engaging a selected one of said openings, with said lug teeth facing said jaw means.

3. The lid wrench of claim 1 wherein said jaw means further comprises a jaw having one end pivotally secured to said lug support and further comprising a set of jaw teeth provided on said jaw, said jaw teeth facing said lug means.

4. The lid wrench of claim 1 wherein:

(a) said lug means further comprises a lug mounted in pivotal and slidable relationship on said lug support and lug teeth and finger means provided on said lug, whereby said lug is selectively pivoted on said lug support to orient said finger means in non-engaging, slidable configuration with respect to said openings and into engaging, non-slidable configuration with said finger means engaging a selected one of said openings with said lug teeth facing said jaw means; and (b) said jaw means further comprises a jaw having one end pivotally secured to said lug support and further comprising a set of jaw teeth provided on said jaw, said jaw teeth facing said lug teeth on said lug when said lug is disposed in said engaging, non-slidable configuration.

5. The lid wrench of claim 1 wherein said lug support is further characterized by an elongated channel having a channel plate and plate flanges extending from said channel plate in spaced, parallel relationship, for receiving said lug means.

6. The lid wrench of claim 5 wherein:

(a) said lug means further comprises a lug mounted in pivotal and slidable relationship on said channel and lug teeth and finger means provided on said lug, whereby said lug is selectively pivoted on said lug support to orient said finger means in non-engaging, slidable configuration with respect to said openings and into engaging, non-slidable configuration with said finger means engaging a selected one of said openings with said lug teeth facing said jaw means; and (b) said jaw means further comprises a curved jaw having one end pivotally secured to said channel plate and further comprising a set of jaw teeth provided on the concave side of said jaw, said jaw teeth facing said lug teeth on said lug.

7. The lid wrench of claim 1 further comprising bias means having one end secured to said lug support and the opposite end of said bias means attached to said jaw means, for normally biasing said jaw handle in extended relationship with respect to said fixed handle and said jaw means in extended relationship with respect to said lug means.

8. The lid wrench of claim 7 wherein said lug means further comprises a lug mounted in pivotal and slidable relationship on said lug support and lug teeth and finger means provided on said lug, whereby said lug is selectively pivoted on said lug support to orient said finger means in non-engaging, slidable configuration with respect to said openings and into engaging, non-slidable configuration with said finger means engaging a selected one of said openings with said lug teeth facing said jaw means.

9. The lid wrench of claim 8 wherein said jaw means further comprises a curved jaw having one end pivotally secured to said lug support and further comprising a set of jaw teeth provided on the concave side of said jaw, said jaw teeth facing said lug teeth on said lugs when said lug is disposed in said engaging, non-slidable configuration.

10. The lid wrench of claim 9 wherein said lug support is further characterized by an elongated channel having a channel plate and plate flanges extending from said channel plate in spaced, parallel relationship.

11. The lid wrench of claim 1 further comprising a jaw plate fixedly carried by said lug support and wherein said fixed handle is fixedly carried by said lug support and said jaw plate, and said jaw means is pivotally attached to said jaw plate and said lug support.

12. The lid wrench of claim 11 wherein:

(a) said lug means further comprises a lug mounted in pivotal and slidable relationship on said lug support and lug teeth and finger means provided on said lug, whereby said lug is selectively pivoted on said lug support to orient said finger means in non-engaging, slidable configuration with respect to said openings and into engaging, non-slidable configuration with said finger means engaging a selected one of said openings with said lug teeth facing said jaw means; and (b) said jaw means further comprises a curved jaw having one end pivotally secured to said lug support and said jaw plate and further comprising a set of jaw teeth provided on the concave side of said jaw, said jaw teeth facing said lug teeth on said lug when said lug is disposed in said engaging configuration.

13. The lid wrench of claim 12 wherein said lug support is further characterized by an elongated channel having a channel plate and plate flanges extending from said channel plate in spaced, parallel relationship, and further comprising a lug pin extending transversely through said lug and beneath said plate flanges for pivotally and slidably adjusting said lug on said channel.

14. The lid wrench of claim 13 further comprising bias means having one end secured to said jaw plate and the opposite end of said bias means attached to said jaw for normally biasing said jaw handle in extended relationship with respect to said fixed handle and said jaw in extended relationship with respect to said lug.

15. The lid wrench of claim 14 wherein said bias means further comprises a coil spring.

16. The lid wrench of claim 1 wherein said lug support is further characterized by a flat plate.

17. The lid wrench of claim 16 wherein:

(a) said lug means further comprises a lug mounted in pivotal and slidable relationship on said flat plate and lug teeth and finger means provided on said lug, whereby said lug is selectively pivoted on said flat plate to orient said finger means in non-engaging, slidable configuration with respect to said openings and into engaging, non-slidable configuration with said finger means engaging a selected one of said openings with said lug teeth facing said jaw means; and (b) said jaw means further comprises a curved jaw having one end pivotally secured to said flat plate and further comprising a set of jaw teeth provided on the concave side of said jaw, said jaw teeth facing said lug teeth on said lug when said lug is disposed in said engaging, non-slidable configuration.

18. The lid wrench of claim 17 further comprising a jaw plate fixedly carried by said flat plate and wherein said fixed handle is fixedly carried by said flat plate and said jaw plate and said jaw is pivotally attached to said jaw plate, and bias means having one end secured to said jaw plate and the opposite end of said bias means attached to said jaw for normally biasing said jaw handle in extended relationship with respect to said fixed handle and said jaw in extended relationship with respect to said lug.

19. A lid wrench for loosening a lid from a container, comprising an elongated, channel-shaped lug support; openings provided in said lug support in spaced relationship; lug means pivotally and slidably carried by said lug support, said lug means adapted to selectively engage and disengage said openings; a fixed handle carried by one end of said lug support in fixed relationship; a jaw pivotally carried by said one end of said lug support in spaced relationship with respect to said lug means; and a jaw handle carried by said jaw in fixed relationship, whereby said lug means and said jaw engage the lid and the lid is loosened on the container responsive to insertion of said lid wrench over the lid with said lid located between said lug means and said jaw, engaging said lug means with a selected one of said openings, squeezing said jaw handle toward said fixed handle and twisting said lid wrench in the counterclockwise direction.

20. The lid wrench of claim 19 wherein said lug means further comprises a lug transversely spanning said lug support, a lug pin extending beneath said lug support and engaging said lug, and finger means and lug teeth provided on said lug, whereby said lug is selectively pivoted on said lug pin with respect to said lug support to selectively orient said finger means in non-engaging, slidable configuration with respect to said openings and into engaging, non-slidable configuration with said finger means engaging a selected one of said openings and said lug teeth facing said jaw means.

21. The lid wrench of claim 20 wherein said lug support is further characterized by an elongated channel having a flat channel plate and plate flanges extending from said channel plate in spaced, parallel relationship, and wherein said lug pin extends through said lug and beneath said plate flanges in spaced, transverse relationship, for pivotally and slidably adjusting said lug on said lug support.

22. The lid wrench of claim 21 further comprising a jaw plate fixedly carried by said plate flanges and wherein said fixed handle is fixedly carried by said elongated channel and said jaw plate and said jaw is pivotally attached to said jaw plate and said elongated channel.

23. The lid wrench of claim 22 further comprising bias means having one end secured to said jaw plate and the opposite end of said bias means attached to said jaw for normally biasing said jaw handle in extended relationship with respect to said fixed handle and said jaw in extended relationship with respect to said lug.

24. The lid wrench of claim 23 wherein said bias means further comprises a coil spring.

25. A lid wrench for loosening a lid from a container, comprising an elongated, flat plate; openings provided in said flat plate in spaced relationship; a lug pin extending beneath said flat plate in transverse relationship; a lug disposed over said flat plate and pivotally carried by said plate pin; and finger means extending from said lug, wherein said lug may be slidably disposed along said flat plate, pivoted upwardly with respect to said flat plate for disengaging said finger means from said openings and said lug may be pivoted downwardly with respect to said flat plate for engaging said finger means with one of said openings; a fixed handle carried by one end of said flat plate in fixed relationship; a curved jaw pivotally carried by said one end of said flat plate in spaced relationship with respect to said lug; and a jaw handle carried by said curved jaw in fixed relationship, whereby said lug is pivoted upwardly of said flat plate to disengage said finger means from said openings and slidably along said flat plate to engage the lid when said curved jaw engages the opposite side of the lid and the lid is loosened on the container responsive to insertion of said lid wrench over the lid with said lid located between said lug and said curved jaw, squeezing said jaw handle toward said fixed handle and twisting said lid wrench in the counterclockwise direction.

26. The lid wrench of claim 25 further comprising a spring guard plate carried by said jaw and wherein said jaw handle is fixedly carried by said spring guard plate.

27. The lid wrench of claim 26 further comprising bias means having one end secured to said flat plate and the opposite end of said bias means attached to said jaw for normally biasing said jaw handle in extended relationship with respect to said fixed handle and said jaw in extended relationship with respect to said lug.

28. The lid wrench of claim 27 wherein said bias means further comprises a coil spring.

* * * * *